US010716733B2

(12) United States Patent
Ingraham

(10) Patent No.: US 10,716,733 B2
(45) Date of Patent: Jul. 21, 2020

(54) CHILD RESISTANT BLISTER PACKAGE

(71) Applicant: Amcor Flexibles, Inc., Mundelein, IL (US)

(72) Inventor: Brian Ingraham, Madison, WI (US)

(73) Assignee: Amcor Flexibles, Inc., Mundelein, IL (US)

( * ) Notice: Subject to any disclaimer, the term of this patent is extended or adjusted under 35 U.S.C. 154(b) by 639 days.

(21) Appl. No.: 13/906,686

(22) Filed: May 31, 2013

(65) Prior Publication Data

US 2013/0256183 A1 Oct. 3, 2013

Related U.S. Application Data

(62) Division of application No. 12/634,158, filed on Dec. 9, 2009, now Pat. No. 8,479,921.

(51) Int. Cl.

| | |
|---|---|
| ***B65D 75/32*** | (2006.01) |
| ***A61J 1/03*** | (2006.01) |
| ***B65B 7/16*** | (2006.01) |

(52) U.S. Cl.

CPC ..... *A61J 1/035* (2013.01); *B65B 7/162* (2013.01); *B65D 75/327* (2013.01); *B65D 2215/00* (2013.01); *B65D 2575/3218* (2013.01)

(58) Field of Classification Search

CPC .... B65D 2575/3227; B65D 2575/3218; B65D 75/327; B65D 81/266; B65D 81/24; B65D 83/0463

USPC .... 206/531, 528, 530, 532, 534, 534.1, 538, 206/539, 484, 469; 229/123, 237

See application file for complete search history.

(56) References Cited

U.S. PATENT DOCUMENTS

| | | | |
|---|---|---|---|
| 5,469,968 | A | 11/1995 | Matthews et al. |
| 5,624,036 | A | 4/1997 | Roulin et al. |
| 5,695,063 | A | 12/1997 | Roulin et al. |
| 5,794,781 | A | 8/1998 | Roulin et al. |
| 5,816,404 | A | 10/1998 | Seidler |
| 5,819,940 | A | 10/1998 | Roulin et al. |
| 5,904,249 | A | 5/1999 | Roulin et al. |

(Continued)

FOREIGN PATENT DOCUMENTS

| | | |
|---|---|---|
| EP | 0 868 366 B1 | 4/2002 |
| EP | 0 777 617 B1 | 9/2002 |

(Continued)

OTHER PUBLICATIONS

Extended European Search Report for European Patent Application No. 10290584.1 dated Mar. 30, 2011; 6 pages.

(Continued)

*Primary Examiner* — Ernesto A Grano

(57) ABSTRACT

A child and bite resistant package having a tray and a plurality of spaced apart cavities that are formed therein is provided. A sheet material overlies the tray such that a product disposed in a cavity is enclosed and sealed therein. The sheet material includes a plurality of zones of weakening that are each disposed above a corresponding cavity. Each of the zones of weakening is formed by a plurality of microperforations that are formed in the sheet material. To access a product, the product is pushed against the lidding in the zone of weakness with sufficient force to rupture the lidding. Since the majority of the surface area above each compartment is non-rupturable, the compartments are difficult to access by a child by either hand manipulation or biting.

22 Claims, 5 Drawing Sheets

(56) References Cited

U.S. PATENT DOCUMENTS

| | | | |
|---|---|---|---|
| 5,908,111 | A | 6/1999 | Purdy |
| 5,988,429 | A | 11/1999 | Coe |
| 6,021,901 | A | 2/2000 | Wolfe |
| 6,024,222 | A | 2/2000 | Friberg et al. |
| 6,092,660 | A | 7/2000 | Rune et al. |
| 6,138,830 | A | 10/2000 | Muggli |
| 6,161,699 | A | 12/2000 | Gartland |
| 6,219,997 | B1 | 4/2001 | Friberg et al. |
| 6,253,920 | B1 | 7/2001 | Kallgren |
| 6,345,717 | B1 | 2/2002 | Flewitt |
| 6,364,155 | B1 | 4/2002 | Wolfe |
| 6,502,717 | B1 | 1/2003 | Wolfe |
| 6,669,236 | B1 | 12/2003 | Hollwarth-Oberholz |
| 6,679,382 | B1 | 1/2004 | Kancsar et al. |
| 6,708,825 | B2 | 3/2004 | Filion et al. |
| 6,726,053 | B1 | 4/2004 | Harrold |
| 6,776,285 | B2 | 8/2004 | Shibata |
| 6,793,077 | B1 | 9/2004 | Kancsar et al. |
| 6,805,258 | B2 | 10/2004 | Cross |
| 6,830,153 | B2 | 12/2004 | French et al. |
| 6,854,618 | B2 | 2/2005 | Harrold |
| 6,896,138 | B2 | 5/2005 | Rock et al. |
| 6,896,139 | B2 | 5/2005 | Kancsar et al. |
| 6,964,338 | B2 | 11/2005 | Kancsar et al. |
| 6,974,031 | B2 | 12/2005 | Kancsar et al. |
| 6,988,618 | B2 | 1/2006 | Dejonge |
| 6,997,320 | B1 | 2/2006 | Kancsar et al. |
| 7,121,410 | B2 | 10/2006 | Rohrmus et al. |
| 7,128,210 | B2 | 10/2006 | Razeti et al. |
| 7,175,044 | B2 | 2/2007 | Benktzon et al. |
| 7,188,728 | B2 | 3/2007 | Williams-Hartman |
| 7,188,729 | B2 | 3/2007 | Dejonge |
| 7,207,440 | B2 | 4/2007 | Briscoe |
| 7,264,137 | B2 | 9/2007 | Drought et al. |
| 7,395,928 | B2 | 7/2008 | Bertsch et al. |
| 7,464,819 | B2 | 12/2008 | Maietta |
| 7,489,594 | B2 | 2/2009 | Simon et al. |
| 2002/0153276 | A1 | 10/2002 | Filion et al. |
| 2002/0166792 | A1 | 11/2002 | Filion et al. |
| 2003/0006163 | A1 | 1/2003 | Patterson |
| 2003/0159774 | A1 | 8/2003 | Fenn |
| 2003/0209461 | A1 | 11/2003 | French et al. |
| 2004/0040881 | A1 | 3/2004 | Grosskopf |
| 2004/0079759 | A1 | 4/2004 | Harrold |
| 2004/0173497 | A1 | 9/2004 | Kancsar et al. |
| 2004/0178111 | A1 | 9/2004 | Harrold |
| 2004/0188312 | A1 | 9/2004 | Stepowany |
| 2004/0188314 | A1 | 9/2004 | Rock et al. |
| 2004/0191476 | A1 | 9/2004 | Wallen et al. |
| 2005/0115862 | A1 | 6/2005 | Maietta |
| 2005/0139505 | A1 | 6/2005 | Miller et al. |
| 2005/0145531 | A1 | 7/2005 | Kancsar et al. |
| 2005/0145532 | A1 | 7/2005 | Kancsar et al. |
| 2005/0161364 | A1 | 7/2005 | Dejonge |
| 2005/0226100 | A1 | 10/2005 | Simon et al. |
| 2006/0006091 | A1 | 1/2006 | Maietta |
| 2006/0086639 | A1 | 4/2006 | Priebe et al. |
| 2006/0157375 | A1 | 7/2006 | Dejonge |
| 2006/0283758 | A1 | 12/2006 | Pasbrig |
| 2006/0289328 | A1 | 12/2006 | Hession |
| 2007/0012592 | A1 | 1/2007 | Bertsch et al. |
| 2007/0056876 | A1 | 3/2007 | Jones |
| 2007/0056982 | A1 | 3/2007 | Webster et al. |
| 2007/0062525 | A1 | 3/2007 | Bonney et al. |
| 2007/0062838 | A1 | 3/2007 | Forman et al. |
| 2007/0068842 | A1 | 3/2007 | Pasbrig |
| 2007/0068844 | A1 | 3/2007 | Weston |
| 2007/0095715 | A1 | 5/2007 | Simon et al. |
| 2007/0138049 | A1 | 6/2007 | Bitner |
| 2007/0224379 | A1 | 9/2007 | Stevenson |
| 2007/0227099 | A1 | 10/2007 | Conti |
| 2007/0227932 | A1 | 10/2007 | Bobbett et al. |
| 2007/0235366 | A1 | 10/2007 | Desai et al. |
| 2007/0241552 | A1 | 10/2007 | Watson et al. |
| 2007/0246395 | A1 | 10/2007 | Arnold et al. |
| 2007/0261984 | A1 | 11/2007 | Gelardi |
| 2007/0267318 | A1 | 11/2007 | Grosskopf |
| 2007/0289893 | A1 | 12/2007 | Williams, Jr. |
| 2008/0135441 | A1 | 6/2008 | Meliniotis et al. |
| 2008/0176037 | A1 | 7/2008 | Ukpabi |
| 2008/0202972 | A1 | 8/2008 | Prud-Homme |
| 2008/0202973 | A1 | 8/2008 | Prud'Homme |
| 2008/0217205 | A1 | 9/2008 | Sattel et al. |
| 2008/0223747 | A1 | 9/2008 | Grosskopf |
| 2008/0223936 | A1 | 9/2008 | Mickle et al. |
| 2008/0230432 | A1 | 9/2008 | Bobbett et al. |
| 2008/0237082 | A1 | 10/2008 | Gherdan et al. |
| 2008/0245698 | A1 | 10/2008 | Young |
| 2008/0251411 | A1 | 10/2008 | Walker et al. |
| 2008/0283435 | A1 | 11/2008 | Morgan |
| 2008/0302695 | A1 | 12/2008 | Meeren et al. |
| 2009/0065506 | A1 | 3/2009 | Currie et al. |
| 2009/0084702 | A1 | 4/2009 | Arnold et al. |
| 2009/0107873 | A1 | 4/2009 | Cotton et al. |
| 2009/0134053 | A1 | 5/2009 | Jeannin et al. |
| 2009/0314664 | A1 | 12/2009 | Henke et al. |

FOREIGN PATENT DOCUMENTS

| | | | |
|---|---|---|---|
| EP | 1 040 051 | B1 | 3/2003 |
| EP | 1 345 753 | A1 | 9/2003 |
| EP | 0 920 296 BI | | 10/2003 |
| EP | 1 088 769 | B1 | 11/2006 |
| EP | 1 173 362 | B1 | 12/2008 |
| GB | 2 414 982 | A | 12/2005 |
| WO | WO 2006/048687 | A1 | 5/2006 |
| WO | WO 2008/014862 | A1 | 2/2008 |

OTHER PUBLICATIONS

Office Action for European Application No. 10 290 584 dated May 28, 2014.

Office Action for European Application No. 10 290 584 dated Jul. 30, 2012.

CHILD RESISTANT BLISTER PACKAGE

CROSS REFERENCE TO RELATED APPLICATIONS

This application is a continuation of U.S. application Ser. No. 12/634,158, filed Dec. 9, 2009, the entire contents of which are incorporated herein by reference.

FIELD OF THE INVENTION

The present invention relates to a blister-type package and in particular to a child resistant blister package.

BACKGROUND OF THE INVENTION

Many medicament products are provided for sale in a blister-type package in which an individual medicament, typically in the form of a caplet, tablet, or capsule, is sealed into an individual compartment from which it can be removed without disturbing the other medicaments. Blister packages typically include a base sheet of plastic material that is molded or thermoformed to provide a tray having a plurality of recesses or cavities that are each adapted to hold an individual medicament. A lidding, also referred to as a backing or retaining sheet, is attached to the base sheet so that it overlies the plurality of cavities and encloses each of the medicaments in their respective cavities.

Many blister packages are designed so the areas of the lidding can be ruptured or opened to provide access to an individual cavity. For example, in one common form of blister package, the lidding comprises a thin sheet of metal foil, such as aluminum, that can be ruptured by pushing on the cavity so that the caplet or tablet ruptures the foil sheet. This form of blister package is commonly referred to as a "push through" type blister package. While this form of blister package generally allows easy access to the medicament, it can pose a safety concern to children because of ease of access. In particular, this form of lidding typically has poor bite resistance. One approach of addressing this problem has been to increase the thickness of the foil sheet to make it more difficult for a child to rupture the foil sheet. However, this can make it more difficult for the elderly and infirm to gain access to their medicament.

Another approach is the so-called "peel push" type blister package. In this approach, the lidding is a multilayer structure in which a polymeric film or paper layer is adhesively attached to a rupturable metal foil layer. The thermoplastic film layer provides bite resistance to the package. The adhesive interface between the metal foil layer and the thermoplastic film layer is weakened so that the film layer can be peeled back so as to expose the rupturable foil layer. Once the film layer has been removed, the medicament can be removed from the package by pushing the medicament through the foil layer as described above. This form of blister package has become the standard blister package for providing child and bite resistant packages.

However, the peel push form of blister package has several disadvantages. In particular, it can be difficult to open, particularly for the elderly or the infirm. Additionally, there have been some issues with the consistency of the peel strength between the thermoplastic film layer and the rupturable foil layer, which may lead to difficulties in access for some patients.

Accordingly, there still exists a need for an improved blister package that is child and bite resistant and that can still be easily opened by the elderly and infirmed.

BRIEF SUMMARY OF THE INVENTION

The present invention is directed to a child resistant blister package that helps solve many of the aforementioned problems. In particular, the present invention provides a blister package for the packaging of a medicament that is child and bite resistant, and that can still be easily opened by the elderly and infirm.

In one embodiment, a blister package is provided that comprises a tray having a plurality of spaced apart cavities that are formed therein. Each of the cavities defines a compartment for receiving a product, such as a medicament therein. A lidding comprising a polymeric sheet material overlies the tray such that a product disposed in each of the compartments is enclosed and sealed therein. In one embodiment, the polymeric sheet material includes a plurality of discrete zones of weakening that are each disposed above a corresponding cavity. Each of the zones of weakening is formed by a plurality of microperforations that are formed in the polymeric sheet material. The plurality of microperforations, and hence, each of the zone of weakening covers from about 5 to 90% of the surface area of the polymeric sheet material that overlies each of the individual compartments. This area of the sheet material defines the zone of weakening in the lidding and also a medicament release zone from which the medicament can be removed from the blister package by rupturing of the lidding. The non-perforated portions of the polymeric sheet material that overly each of the compartments is resistant to being ruptured or torn. To access a product disposed in one of the compartments, the product, such as a medicament, is pushed against the lidding in the zone of weakness with sufficient force to rupture the lidding in this weakened region. However, since the majority of the surface area above each compartment is non-rupturable, the compartments are difficult to access by a child by either hand manipulation or biting. As a result, blister packages in the accordance with the present invention are child and bite resistant while still being capable of being easily opened by the elderly and infirm.

The microperforations are small tears or holes that are formed in the polymeric sheet material, and that typically have a size ranging less than about 250 μm, and in particular, less than about 30 μm. The density of the microperforations in the zone of weakening is generally from about 100 to 400 perforations per $cm^2$, which a density from about 200 to 300 being somewhat more typical. In one embodiment, the microperforations can be made in the polymeric sheet material by passing the sheet material through an embossing roll having a plurality of needles/pins that are configured and arranged to form a plurality of microperforations in the lidding material in a desired location and pattern.

In one embodiment, the blister package includes a tray in which the cavities include at least two converging sidewalls that converge to form a corner. Preferably, the zone of weakening is disposed opposite the corner such that it overlies a corner of the blister package and at least partially overlies the two converging sidewalls. Positioning the zone of weakening adjacent to the sidewall, and in particular, a corner of the cavity, helps to facilitate rupturing of the zone of weakening when a pushing force of sufficient strength is applied to the zone of weakening. In one particular embodiment, each of the zones of weakening comprise from about 5 to 35%, and more particularly, from about 10 to 25% of the surface area of the lidding that overlies each of the compartments.

In one embodiment, the lidding may also have barrier properties. For instance, in a preferred embodiment, the lidding includes an outer polymeric layer in which the zones of weakening are formed, a rupturable barrier layer, such an aluminum foil layer, disposed towards the surface of the lidding in which the compartments are formed, and heat seal coating layer disposed on an inner surface of the rupturable barrier layer, and an adhesive layer joining the polymeric layer and the rupturable barrier layer to each other.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
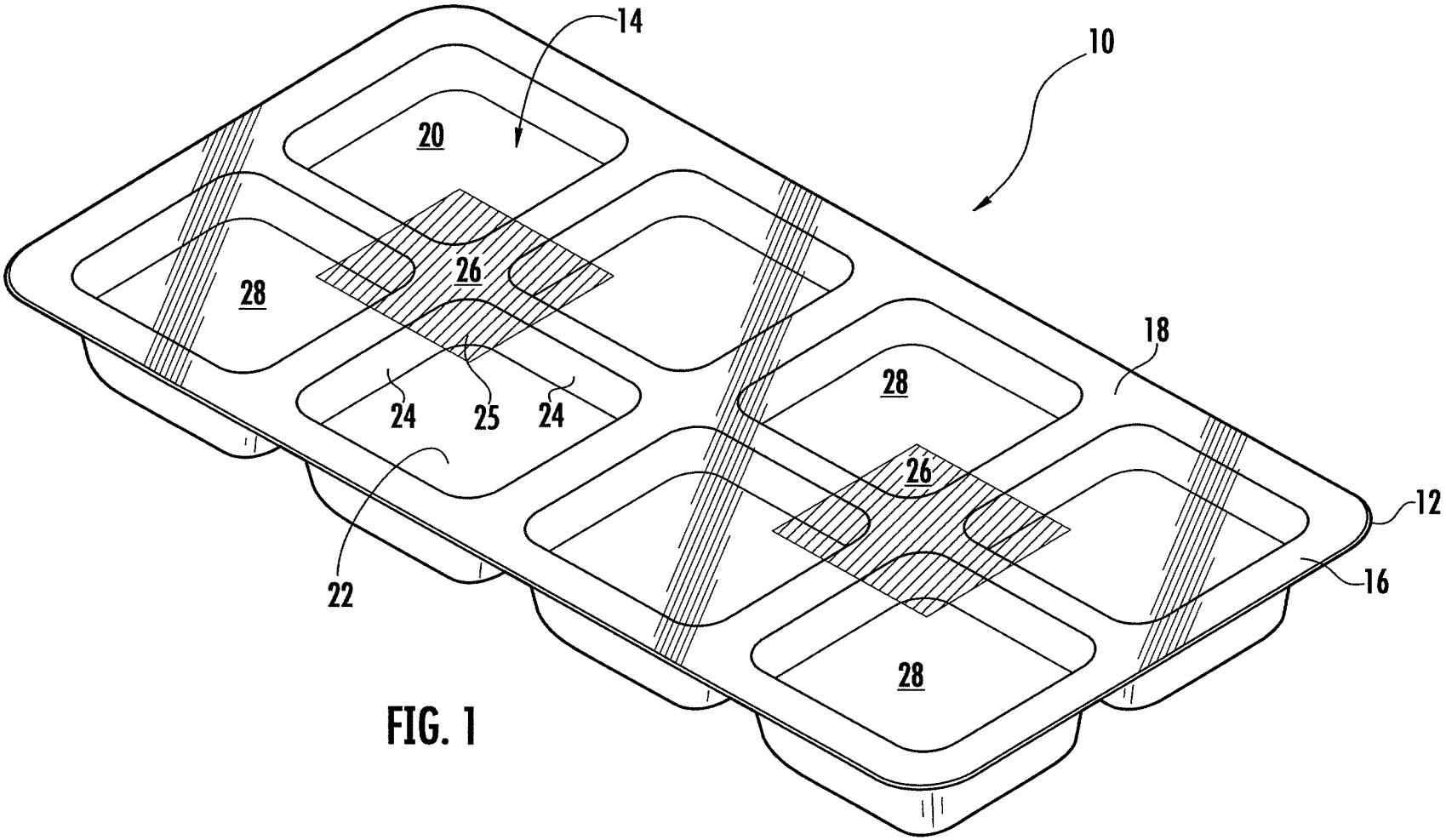
FIG. 1 is an perspective view of a blister package that is in accordance with one embodiment of the present invention.
Figure 2:
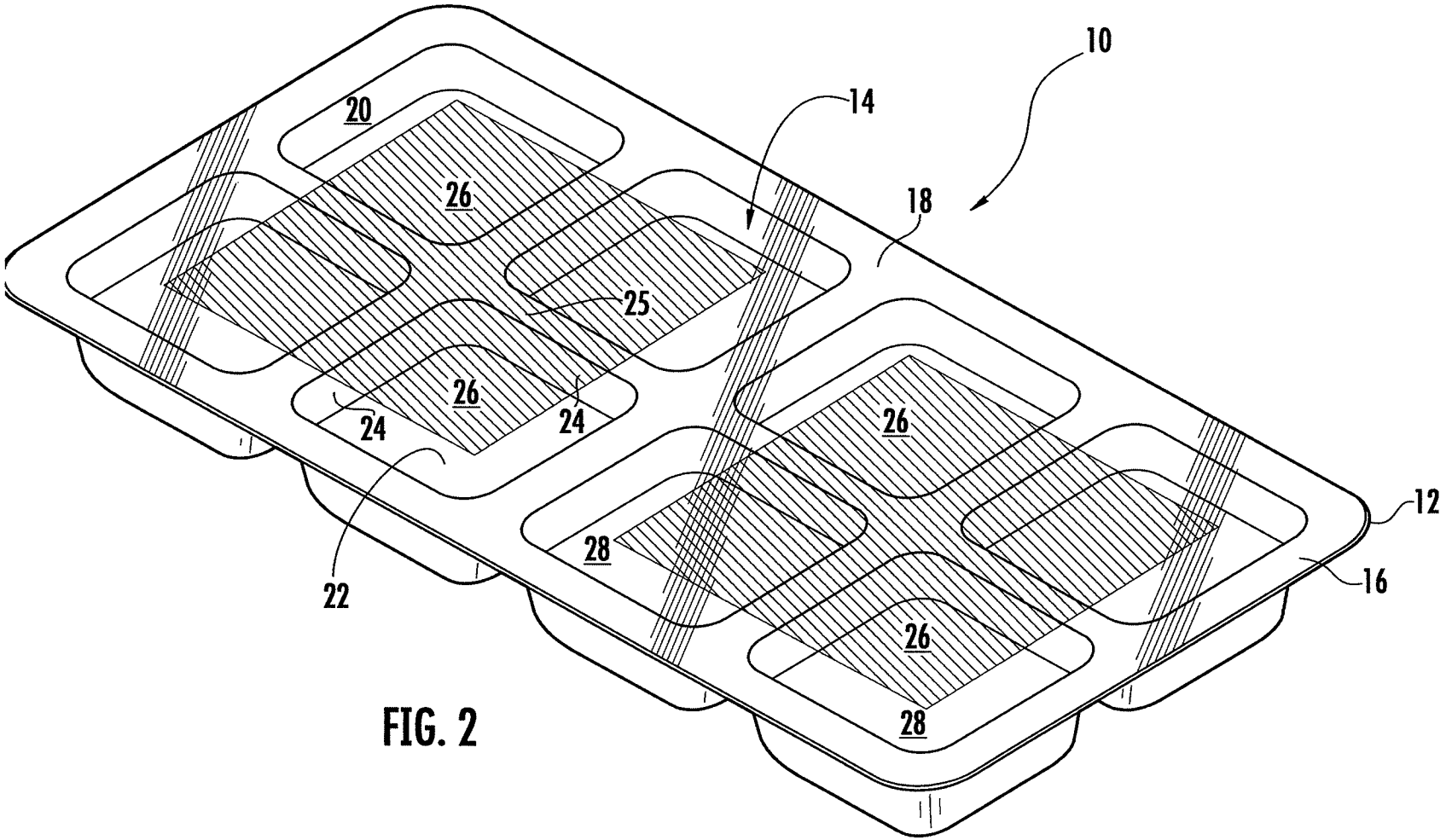
FIG. 2 is a perspective view of a blister package that is in accordance with a further embodiment of the present invention.

With reference to FIGS. 1 and 2, a blister-type package that is in accordance with an embodiment of the present invention is illustrated and broadly designated by reference number 10. The blister package 10 includes a tray 12 having a plurality of cavities (also known as blisters, pockets, or recesses) 14 formed therein. The tray comprises a base sheet 16 having a surface 18 in which the cavities 14 are formed to define compartments that are each adapted for containing an individual medicament therein.

The blister package includes a lidding 20 that overlies surface 18 of the tray and encloses an individual medicament in its respective compartment (i.e., cavity 14) of the blister package. As explained in greater detail below, the lidding comprises a polymeric sheet material having a plurality of microperforations that define a plurality of discrete zones of weakening in the lidding. The zones of weakening each overly from about 5 to 35% of the surface area of the lidding overlying an individual compartment. The remainder of the surface area of the lidding above each of the compartments does not include microperforations and therefore defines a puncture or tear resistant zone in the lidding. The lidding is positioned and secured on the tray so that a zone of weakening overlies at least a portion of each cavity. In use, a patient can access an individual compartment by applying a pushing force to the medicament so that it pushes on the zone of weakening which causes the polymeric sheet material to rupture in the area above the compartment. The patient can then remove the medicament from the compartment from the thus created opening in the lidding. The use of microperforations in select regions or zones of the polymeric sheet material provides easy access to the compartment without weakening the strength of the remaining portions (non-microperforated) of the lidding. As a result, the invention provides a blister package that is both child and bite resistance, while being capable of being readily opened by seniors and the infirm.

Blister packages in accordance with the present invention can be used to package a variety of different products including over the counter and prescription medicaments. Additionally, the medicaments can be in a variety of different forms including pills, caplets, tablets, capsules, and the like. Blister packages in accordance with the present invention can also be used in other applications including medical packaging, such as syringes, pipettes, etc, chemicals, such as poisons, industrial applications, food applications, and the like.

Each cavity includes a base or bottom surface 22 and at least one sidewall 24 extending from the bottom surface 22 to surface 18. If the cavity has a square or rectangular shape, the cavity will include at least 4 sidewalls. If the cavity has a circular, oval, or similar shape, the cavity will have a continuous sidewall that extends about the perimeter of the cavity. It should be understood that blister packages in accordance with the present invention are not limited to any particular shape or configuration provided the individual compartments can be easily opened without sacrificing the child and bite resistant properties of the package.

The tray, also commonly referred to as a blister sheet may be formed from a single sheet of material which is made of a suitable material. The tray 12 may be a rectangular continuous sheet of a transparent film or plastic which cannot easily be ruptured by biting or tearing or other means. Such a sheet 16 may be, for example, a polyvinyl chloride thermoplastic film of about 350 μm thick or less. Suitable materials which may be used for the tray 12 are known by those of skill in the art, are commercially available and include a variety of polymers and copolymers, such as polyvinyl chloride, nylon, polyethylene terephthalate, polyethylene, polypropylene, polystyrene and similar materials. Additional materials for the tray include metallic foils and foil laminates, and similar materials. The tray can also be comprised of a unitary structure, a laminate, or a multilayer film structure. In some embodiments, the tray 12 may be square, triangular, round, oval or of any other convenient shape.

The tray 12 is made in a manner known by those of skill in the art, such as by extrusion, blown or tenter processes. Preferably, tray 12 is formed from a plastic base sheet that has been molded or thermoformed to have the desired shape and configuration, and includes a plurality of cavities 14 formed in a row as is known to one of ordinary skill in the art. In the illustrated embodiment, the blister package includes two aligned vertical rows having five blisters per row. It should be recognized that the present invention is not limited to any particular arrangement and number of cavities per blister package.

If desired, the tray 12 may be made of an opaque or amber material so as to prevent light from reaching medications disposed in the individual compartments which deteriorate when exposed to light.

In order to prevent a child or impaired adult from tearing, biting through or otherwise rupturing the tray 12 and obtaining access to the contents of the blister package, the thickness of the tray 12 should range from about 150 to 350 μm, and should preferably be about 250 μm.

The tray 12 has an outer surface (that surface of the tray 12 which is not adhered to the lidding 20) an inner surface 18 (that surface of the tray 12 which is adhered to the lidding 20), with from one to a plurality of separate, flexible cavities projecting from its outer surface to contain medications and/or other articles of any desired shape, and which generally conform to the size and/or shape of the particular articles to be contained within the article-receiving pockets. One or more cavities may be cold-, thermo- or pressure formed into the base sheet 16 of the tray 12 by conventional forming methods known by those of skill in the art. They may be spaced apart at regular intervals and may house one or more medicaments or other articles.

The cavities 14 of the blister packages of the present invention are generally filled with the desired medicaments or other articles prior to having the lidding 20 adhered to the other tray 12.

As noted above, the lidding includes a polymeric sheet material having zones of weakening formed therein. Suitable materials for the polymeric sheet material are discussed in greater detail below. As can be seen in FIGS. 1 and 2, the zones of weakening are represented by the shaded area indicated by reference number 26. The zones of weakening each comprise an area of the sheet material having a plurality of microperforations. The size and density of the microperforations is generally selected so that the force need to puncture the lidding in the area of the zone of weakening is less than 36 newtons (N), and preferably less than about 30 N, and more preferably less than about 26 N as measured in accordance with FTMS 101C. In comparison, the non-weakened zones 28 (the area that is non-perforated) of the lidding overlying each of the cavities generally has a puncture resistance greater than 36 N and in particular, greater than about 52 N. The non-weakened zones refer to the regions of the lidding overlying each cavity that do not include microperforations. Unless stated to the contrary, the force necessary to puncture or tear the lidding was measured in accordance with FTMS 101C, the contents of which are incorporated by reference.

The density of the microperforations in the zone of weakening is typically from about 10 to 1000 microperforations per square centimeter ($cm^2$), and in particular, from about 100 to 400 per $cm^2$, and more particularly, from about 200 to 300 microperforations per $cm^2$. The microperforations are small tears or openings that are created in the sheet material and can be of any shape or configuration. The microperforations are typically less than about 250 μm in length or diameter, and in particular, less than about 200 μm in length or diameter. In a preferred embodiment, the size of the microperforations are less than about 100 μm, and more preferably less than about 50 μm, and even more preferably less than 30 microns. In one particular embodiment, the microperforations may have a size that is from 5 to 10 μm.

Figure 3:
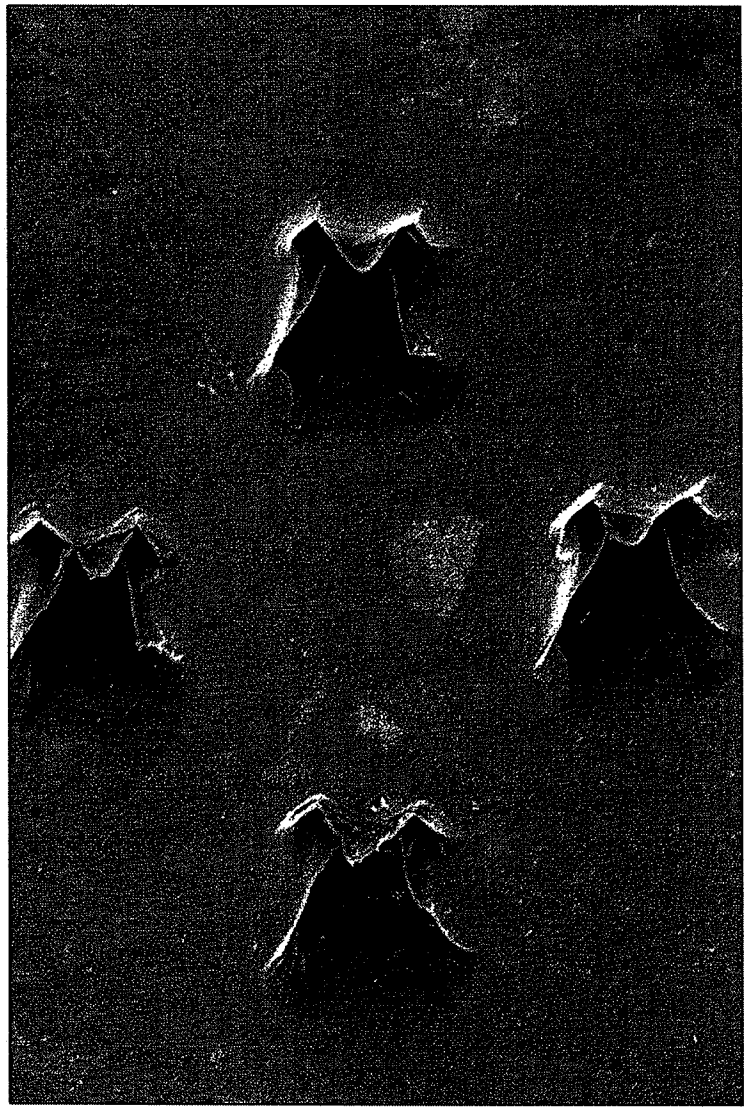
FIG. 3 is a micrograph image of a sheet material that shows microperforations that are in accordance with the present invention.

In one embodiment, the microperforations are formed from a pair of micro slits or cuts that bisect each to form a microperforation having a cross-like or x-like shape. The micro slits or cuts forming such a microperforation typically have a length that is from about 10 to 120 μm. In this regard, FIG. 3 is a micrograph image taken of a sheet material having a plurality of microperforations that is in accordance with at least one embodiment of the present invention. In other embodiments, the microperforations may be chevron shaped, triangular, circular, prismatic, serrated, diamond shaped, zigzagging, cross shaped or crescent shaped, or are arranged in a honeycomb configuration. Different shapes are appropriate for different applications.

The microperforations can be created by passing the polymeric sheet material through an embossing roll having a plurality needles/pins so as to produce zones of weakening the polymeric sheet material. Each of the needles/pins creates a microperforation in the sheet material. The configuration and arrangement of the needles is selected so as to produce a desired pattern of zones of weakening in the sheet material. Preferably, the microperforations are formed in the polymeric sheet material prior to laminating the sheet material to any additional layers. A system and method that may be used to make the microperforations is described in European Patent Publication No. EP1345753 (A1).

In the embodiment illustrated in FIG. 1, the relative size of each of the zones of weakening in comparison to the overall surface area of the lidding that overlies each of the cavities is relatively small. As a result, the majority of the surface area of the lidding overlying each cavity is puncture or tear resistant and will not be easily punctured due to biting or rough handling by a child. FIG. 2 illustrates an embodiment of the blister package in which the size of the zone of weakening zone in comparison to the overall surface area of the lidding that overlies each of the cavities is relatively large. Generally, the surface area of each zone of weakening overlying a corresponding cavity is typically from about 5 to 90% of the total surface area, and in particular from about 5 to 35% of the total surface area of the lidding overlying an individual cavity. In a preferred embodiment, the size of each zone of weakening is from about 10 to 25% of the surface area of the lidding overlying each cavity.

Additionally, it has been found that by positioning a zone of weakening adjacent to a sidewall of each cavity, an easy open blister package is provided that also has improved child and bite resistance. Preferably, the zone of weakening overlies at least a portion of the sidewall of the corresponding cavity.

In a preferred embodiment, the cavities each include at least two sidewalls 24 that converge to form a corner 25 within the cavity. In this embodiment, the zone of weakening 26 overlying each cavity is desirably positioned so that it is disposed above at least one corner 25 of the cavity. It has been found that by positioning the zone of weakening opposite a corner of the cavity, a minimum area of zone of weakening is needed to initiate puncturing of the lidding. As a result, blister packages in accordance with the present invention are child and bite resistant.

Figure 4:
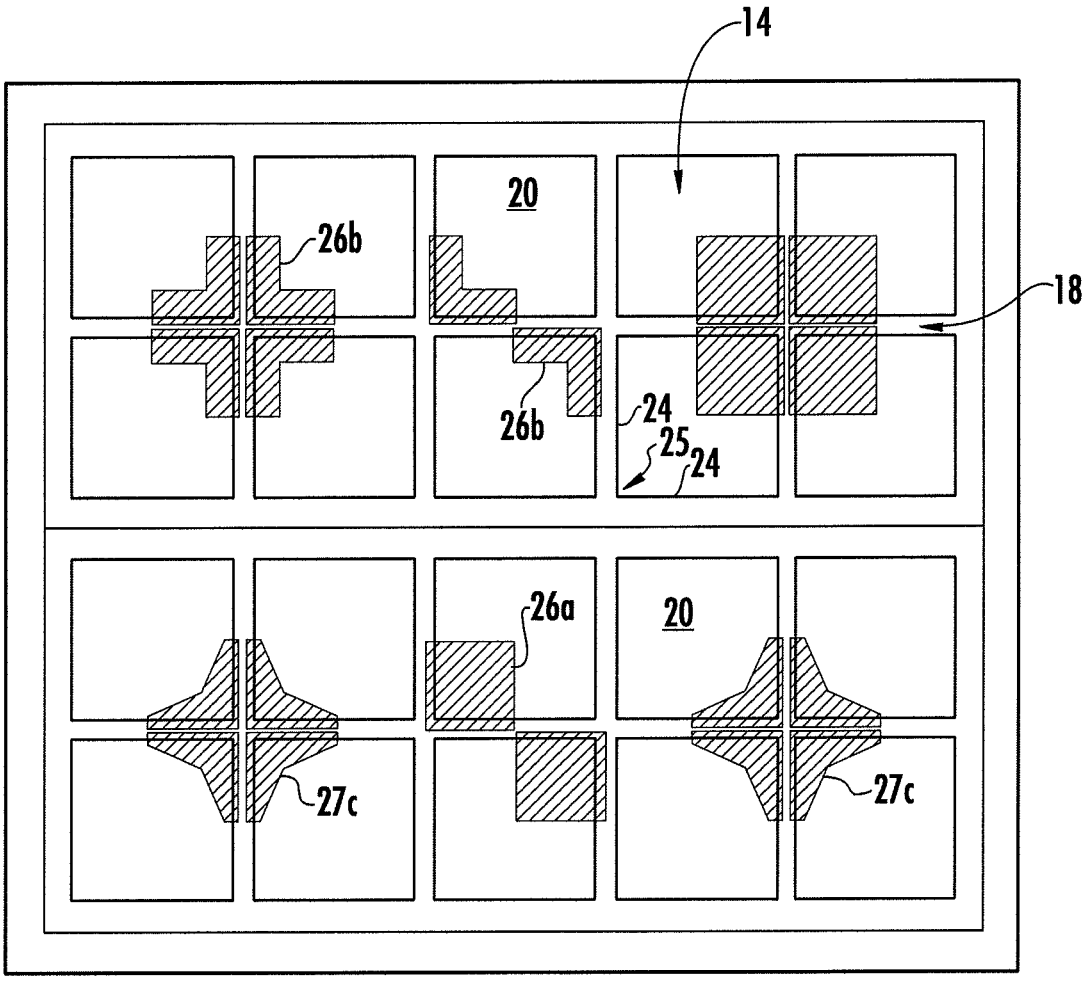
FIG. 4 illustrates representative zones of weakness that may be used in accordance with the present invention.

The zone of weakening can be configured and arranged to have a wide variety of shapes and/or patterns. For example, in FIG. 4 illustrates some representative patterns for the zone of weakening that may be used in accordance with the present invention. As shown, the zone of weakening can have a square shape 26*a*, L-shape 26*b*, chevron shape 27*c*, or the like. The zone of weakening is not limited to any particular shape, for example, it can be circular, oval, rectangular, star-shape, etc. In one embodiment, the shape of the zone of weakening can be in the form of a logo of the manufacturer or supplier of the medicament or packaged article. Additionally, the lidding may include a combination of different patterns for the blister pack depending on the configuration and arrangement of the individual cavities.

In some embodiments, it may also be desirable to have the zone of weakening in the sheet material be positioned so that it extends and slightly overlies a portion of surface 18 of the tray 12. For example, in FIGS. 1, 2 and 4 it can be seen that each zone of weakening overlies a portion of surface 18 that is adjacent to the sidewalls of the cavities. Generally, the portion of the zone of weakening that extends over an adjacent surface 18 of the tray is about 10 to 15% of the overall surface area of the zone of weakening for a respective cavity. Extending the zone of weakening over the sidewall allows for greater degrees of freedom with respect to the alignment of the lidding over the tray during the manufacturing process.

In one embodiment, the outer surface of the lidding can be printed or marked with an appropriate indicia and/or instructions that direct a patient to an appropriate region of the lidding for which to apply a pushing force against. In this way, adults are instructed on how to safely use and access the individual compartments of the blister package.

Figure 5:
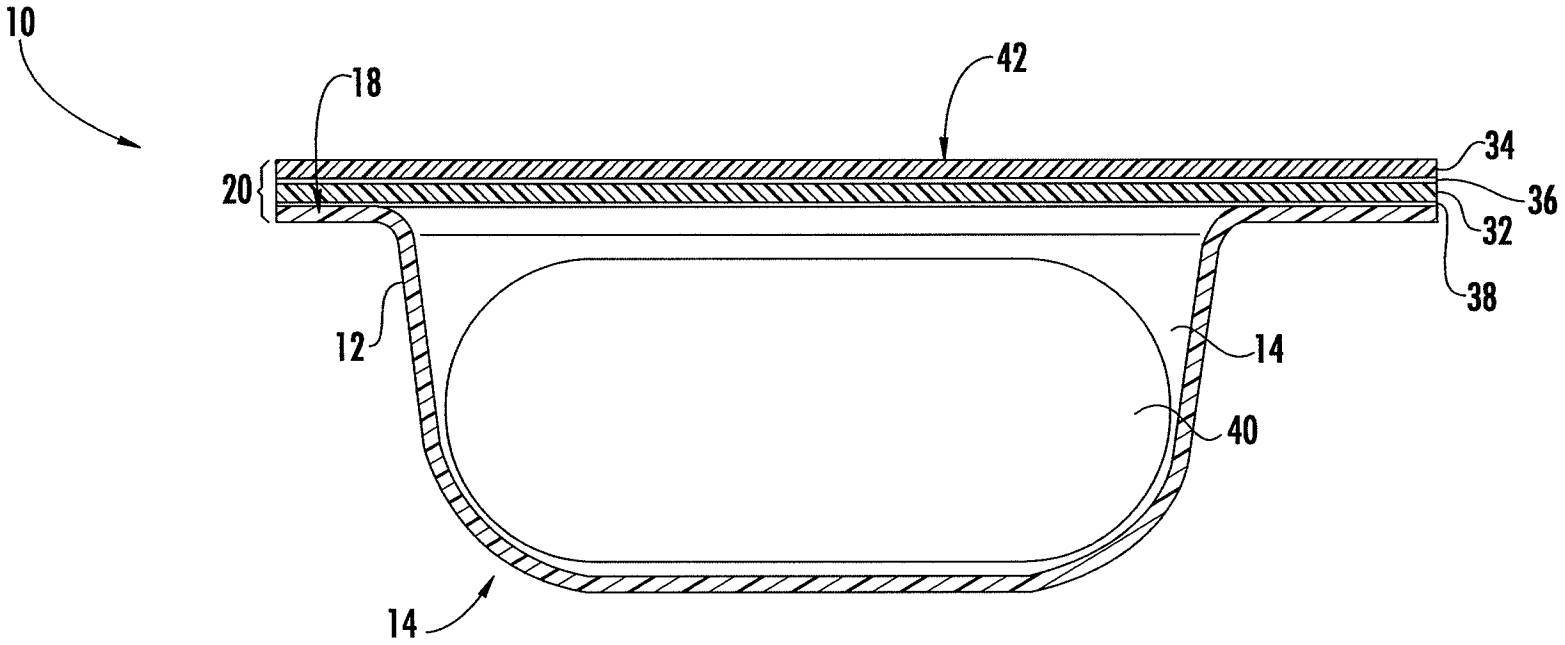
FIG. 5 is a cross-sectional side view of tray and lidding that is in accordance with at least one embodiment of the present invention, and in which the lidding includes at least four layers.

In some embodiments, the blister package may also have barrier properties. In this regard, FIG. 5 illustrates an embodiment of the invention in which the lidding 20 includes a rupturable barrier layer 32 that is positioned adjacent to the surface 18 of the tray, and a polymeric layer 34 disposed towards an outer surface of the lidding. In the illustrated embodiment, polymeric layer 34 defines an outer surface 42 of the blister package. The polymeric layer 34 and rupturable barrier layer 32 may be adhesively joined to together with adhesive layer 36. A medicament 40, such as a pill, is shown as being sealed in cavity 14.

The polymeric layer 34 comprises a sheet material having zones of weakening as discussed above. The purpose of the polymeric layer 34 is to provide a layer that is bite and child resistant while at the same time is capable of having a zone of weakness formed therein. In particular, the polymeric layer helps to prevent a young child or impaired adult from accessing a medicament or other article contained in cavity by merely applying pressure to the cavity. Because the polymeric layer 34 is made of a material which cannot be ruptured by the application of pressure, or by biting, the user of the blister package of the invention must apply pressure in the zone of weakening in order to obtain access to the article contained in the compartment.

The polymeric layer 34 can be selected from a layer or sheet of a strong flexible material of sufficient puncture resistance that a medicament or other article cannot be forced through the material in a puncture resistant zone of the lidding with the application of pressure, and cannot be accessed by biting through the material. A wide variety of commercially-available plastic or other materials may be employed as the polymeric layer 34. Suitable materials for the polymeric layer may include polyolefins, such as polyethylenes and polypropylenes, polyesters, such as polyethylene terepthalate (PET), nylons, including biaxially oriented nylon (BON), biaxially oriented polypropylene, biaxially oriented HDPE, and the like. In a preferred embodiment, the polymeric layer comprises polyethylene terepthalate. The thickness of the polymeric layer is typically from about 0.25 to 2 mils, and in particular, from about 0.4 to 1 mil.

When present, the rupturable barrier layer typically comprises a sheet of material having barrier properties and that can be easily ruptured by the application of a sufficient pushing force or pressure. In particular, the rupturable barrier layer 32 is preferably formed from a fragile barrier material, such as a coated paper, selected plastics, such as cellophane, polyethylene, polypropylene, foil and other materials known by those of skill in the art, all of which are commercially available. More desirably, suitable materials for the rupturable barrier layer include metal foils, such as aluminum foil, polymeric films, such as PET, polyvinyl chloride, PET-SiOx, polychlorotrifluoroethylene (PCTFE), polyvinylidene chloride (PVdC), and metalized polymeric films, including metalized PET such as PET-AlOx.

The rupturable barrier layer 32 may be attached to the tray 12 by methods known by those of skill in the art such as heat-sealing, solvent welding, gluing or otherwise adhering this layer to the tray 12. Desirably, the rupturable barrier layer 32 of the blister packages of the invention can prevent moisture and contaminants from penetrating into the cavities formed in the tray.

Typically, the rupturable barrier layer 32 may be ruptured by the application of pressure. Thus, a medicament or other article contained in a cavity 14 may be accessed by the application of pressure on the article in the direction towards the rupturable barrier layer 32 and the overlying zone of weakness in the polymeric layer 34.

The thickness of the rupturable barrier layer 32 is not critical, and ordinarily will be maintained within a range which provides adequate protection for the package contents, while still being capable of rupture without the application of undue force. The thickness of the rupturable barrier layer is typically from about 0.2 mils to 2 mils, and in particular, from about 0.28 mils to 1.5 mils. In a preferred embodiment, the rupturable barrier layer comprises a metal foil, such as aluminum, having a thickness from about 0.5 to 1.5 mils, and in particular, a thickness that is from about 0.75 to 1 mil.

The rupturable barrier layer 34 may be of any convenient shape and size, but typically must be large enough to cover any cavities which may be present in the blister package. This layer will generally be the same size and shape as the blister package itself, and as the tray 12.

Because the materials described directly above may not readily be heat sealable to the tray 12 to form an air-tight sealed package, it is generally necessary, with such materials, to provide a layer of a heat sealable coating material 38 on the surface of the rupturable barrier layer 32 which faces tray 12. For example, in one embodiment, the lidding may include a heat seal coating layer (not shown) that is disposed between surface 18 and the rupturable barrier layer 32. Heat sealable layer comprises a thermoplastic polymer material that can be used to heat seal the lidding to the surface 18 of the tray. Such coatings are well known in the art, and may be selected from such materials as vinyls, acrylics or polyolefins, which are applied by spraying, dipping or similar techniques. In one embodiment, suitable materials for the heat seal coat layer include acrylates including vinyl acrylates, ethylene-co-acrylic acid, acetates, such as ethylene vinyl acetate, ethylene methyl acetate, olefins, such as polyethylenes and polypropylenes, ionomers, and the like. In one embodiment, the heat sealable coating layer may be applied to the rupturable barrier layer as a coating. The heat sealable coating layer is typically applied at a weight ranging from about 0.75-5.0 pounds per ream, with about 3.0 pounds per ream being somewhat preferred. The heat seal layer can also be applied as a hot melt or extrusion coating.

Other methods of joining the lidding to the tray may include the adhesives, RF sealing, ultrasonic welding, and the like.

FIG. 5 illustrates a preferred embodiment of the lidding 20 that is in accordance with an embodiment of the present invention. In this embodiment, the lidding 20 comprises a four layer laminate structure having a polymeric layer 34 as described above, rupturable barrier layer 32, an adhesive layer 36 joining the polymeric layer and rupturable barrier layer, and a heat seal coating layer 38 disposed on an inner surface of the rupturable barrier layer. As noted above, the heat seal coating layer comprises a polymeric material that can be used to heat seal the lidding to the tray. It should be recognized that the present invention includes other configurations and arrangements of the lidding structure. For example, the lidding may include a polymeric layer 34 that is positioned towards the tray while the rupturable barrier layer 32 is positioned towards an exterior surface of the lidding.

The adhesive layer 36 is a layer of material which is optionally employed in the blister packages of the invention to adhere the polymeric layer 34 to the rupturable barrier layer 32. Examples of materials which are suitable for use as the adhesive layer 36 are known by those of skill in the art, and include polyurethane, polyethylene, polyester, vinyl and acrylics. All of these materials are commercially available. The adhesive layer 36 may be applied by methods known by those of skill in the art, such as by curtain or roller coatings, in an amount ranging from about 3.5 pounds per ream to about 1 pound per ream, and in particular from about 2.0 pounds per ream to about 1.4 pounds per ream.

In a preferred embodiment of the invention, where a metallic foil is employed as the rupturable barrier layer 32 and a polyester is employed as the polymeric layer 34, an adhesive comprising polyurethane is preferred.

One of ordinary skill in the art upon reading the description herein will recognize that embodiments of the inventive blister package can be used to comply with the standards of the Poison Prevention Packaging Act of 1970, 15 USC § 1471-1475, and with the Act's associated regulations, 16 CFR § 1700.1-1700.20, which describe test procedures in which packages are given to children for a given period of time to determine the accessibility to the children of the package contents. These standards have been promulgated by the Consumer Product Safety Commission as standards which reasonably protect children from entering packaging that would contain potentially harmful substances.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A child resistant package comprising:

a tray having a plurality of spaced apart cavities formed therein, each of the cavities having at least one sidewall defining a compartment for receiving a product therein; and a polymeric sheet material overlying said tray such that a product disposed in each of the compartments is enclosed therein, wherein each region of the sheet material overlying an individual compartment includes a plurality of microperforations defining a zone of weakening in which the plurality of microperforations are disposed in a discrete location above each individual compartment, and a puncture and/or tear resistant zone that is free of said microperforations, and wherein said zone of weakening is positioned along at least one sidewall of said individual compartment.

2. The package according to claim 1, further comprising a rupturable barrier layer disposed between the polymeric sheet material and the tray.

3. The package according to claim 1, wherein the rupturable barrier layer is selected from the group consisting of coated paper, a polymeric film, and metal foils.

4. The package according to claim 1, wherein the rupturable barrier layer comprises aluminum foil.

5. The package according to claim 1, wherein the cavities have a shape selected from the group consisting of a square, rectangle, circle, and oval.

6. The package according to claim 1, wherein the zone of weakening has a shape selected from the group consisting of a square, rectangle, L-shape, chevron shape, circular shape, and oval shape.

7. The package according to claim 1, wherein the microperforations in the zones of weakening are present in a density that is from about 100 to 1,000 microperforations per $cm^2$.

8. The package according to claim 1, wherein the microperforations in the zones of weakening are present in a density that is from about 200 to 300 microperforations per $cm^2$.

9. The package according to claim 1, wherein each of the microperforations have a size ranging from about 5 to 10 μm.

10. The package according to claim 1, wherein the zone of weakening overlies at least a portion of the sidewall of a corresponding cavity.

11. The package according to claim 10, wherein 10 to 15% of the zone of weakening overlies said at least a portion of the sidewall of a corresponding cavity.

12. The package according to claim 1, wherein each cavity includes at least two sidewalls that converge to define a corner and wherein each zone of weakening overlying an individual compartment is disposed so that it overlies said corner.

13. The package according to claim 1, wherein the polymeric sheet material is selected from the group consisting of polyethylene terepthalate, oriented nylon, non-oriented nylon, non-oriented polypropylene, and oriented polypropylene.

14. The package according to claim 1, wherein the tray includes an inner surface that is adhered to the polymeric sheet material, and wherein a portion of each zone of weakening overlies, and is attached to, said inner surface.

15. The package according to claim 1, wherein the plurality of microperforations are not distributed across the entire polymeric sheet material.

16. A method of making the child resistant package according to claim 1, the method comprising the steps of providing a polymeric sheet material having discrete regions that each comprise a plurality of microperforations formed in the sheet material;

positioning the sheet material over a tray having a plurality of cavities, wherein the sheet material is positioned such that each region of the sheet material overlying an individual compartment includes a zone of weakening defined by said plurality of microperforations, and a puncture and/or tear resistant zone that is free of said microperforations, and wherein said zone of weakening is positioned along at least one sidewall of a corresponding cavity, and wherein the plurality of microperforations are disposed in a discrete location above each individual compartment; and attaching the sheet material to the tray.

17. The method according to claim 16, wherein the step of providing a polymeric sheet material comprises passing the sheet material through an embossing roll configured to form the discrete regions of microperforations.

18. The method according to claim 16, wherein a density of microperforations in each zone of weakening is from about 100 to 1,000 microperforations per $cm^2$.

19. The method according to claim 16, further comprising placing a medicament into the plurality of cavities prior to attaching the sheet material to the tray.

20. The method according to claim 16, wherein the polymeric sheet material includes a rupturable barrier layer.

21. The method according to claim 16, wherein the cavities have a shape selected from the group consisting of a square, rectangle, circle, and oval.

22. The method according to claim 16, wherein the zone of weakening has a shape selected from the group consisting of a square, rectangle, L-shape, chevron shape, circular shape, and oval shape.

* * * * *